US007490674B2

(12) United States Patent
Brecheisen

(10) Patent No.: US 7,490,674 B2
(45) Date of Patent: Feb. 17, 2009

(54) DUAL CYLINDER LIFT PUMP AND METHOD OF RECOVERING FLUIDS FROM SUBSURFACE FORMATIONS

(76) Inventor: Marion Brecheisen, 710 W. T. Jones Rd., Holcomb, KS (US) 67851

( * ) Notice: Subject to any disclaimer, the term of this patent is extended or adjusted under 35 U.S.C. 154(b) by 136 days.

(21) Appl. No.: 11/478,202

(22) Filed: Jun. 29, 2006

(65) Prior Publication Data

US 2008/0000631 A1 Jan. 3, 2008

(51) Int. Cl.
*E21B 34/10* (2006.01)

(52) U.S. Cl. ..... 166/369; 166/72; 417/545

(58) Field of Classification Search ..... 166/369, 166/68.5, 72; 60/372; 417/545
See application file for complete search history.

(56) References Cited

U.S. PATENT DOCUMENTS 4,380,150 A * 4/1983 Carlson ..... 60/372
5,996,688 A 12/1999 Schultz et al.
5,997,181 A * 12/1999 Stanley ..... 384/273
6,460,396 B1 * 10/2002 Smedberg et al. ..... 72/453.13
6,966,366 B2 11/2005 Rogers, Jr.
2005/0000632 A1 * 1/2005 Brecheisen ..... 166/72

* cited by examiner

*Primary Examiner*—William P Neuder
(74) *Attorney, Agent, or Firm*—The Reilly Intellectual Property Law Firm, PC; John E. Reilly, Esq.

(57) ABSTRACT

A pump jack system for reciprocating a pump rod string is made up of a base frame and piston drive cylinders mounted on the base frame with the upper end of the pump rod connected to the cylinder assemblies, the cylinder assemblies being operated in unison by a fluid control circuit communicating with inner and outer concentric fluid passages, and the pump rod string is counterbalanced by a fluid circuit which supplies pressure in an upward direction to each of the pistons on each upstroke and substantially reduces the pressure on each downstroke, the fluid circuit being selected from an inert gas alone or an inert gas pressurizing a hydraulic fluid.

24 Claims, 6 Drawing Sheets

DUAL CYLINDER LIFT PUMP AND METHOD OF RECOVERING FLUIDS FROM SUBSURFACE FORMATIONS

BACKGROUND AND FIELD

This invention relates to down-hole pumping systems and more particularly relates to a low profile pump jack system and method of extracting fluids, such as, oil and gas from subsurface formations.

A wide variety of pumping devices have been developed over the years for extracting fluids from wells drilled into subsurface formations. One well-known device, commonly referred to as a "walking beam pump" is characterized by having a sucker rod string attached to one end of the beam, the beam being driven by a motive drive source, such as, a motor coupled to the opposite end of the beam by a pitman arm. Typically, the sucker rod will extend for considerable distances into the well and is connected to a down-hole pump, and in response to rocking motion of the walking beam initiated by the prime mover through the pitman arm is raised and lowered to result in drawing of the fluid out of the well.

The rocking motion of the walking beam will counterbalance the weight of fluid being lifted and which reaches a maximum when the sucker rod begins its upward stroke owing in part to the weight of the sucker rod string, the weight of the fluid being lifted and the force required to overcome the inertia of the load following the downstroke of the sucker rod; and in deep wells on the order of 5,000' to 6,000', the weight of the sucker rod and oil being lifted can be in excess of 8,000 lbs. An equal, if not greater, load is imposed on the motive drive source on each downstroke owing to the resistance encountered in overcoming fluid pressure as the pump rod advances through the formation. The disadvantages and drawbacks of the walking beam pump jacks are well-known and documented at some length, as a result of which numerous different approaches have been utilized with varying degrees of success. Nevertheless, there remains a need for a pump jack which is low profile, can be mounted above or below ground level together with an adjustable length stroke and extremely low power requirements and in so doing overcome the inherent problems of rod speed and stroke control in the walking beam pumps.

SUMMARY

In one important feature of the invention, novel and improved well head cylinders operate in unison on opposite sides of a pump or sucker rod; further, each of the cylinders is counterbalanced either by a combination of nitrogen gas over hydraulic fluid or nitrogen gas alone with substantially lower horsepower requirements due to cylinder efficiency and counterbalancing of the load or weight of the sucker rod string, the amount of fluid being lifted and inertia of the load following each downward stroke as well as to counterbalance the forces or resistance to advancement of the sucker rod on each upstroke.

According to another feature of the invention, the counterbalancing cylinders on opposite sides of the pump rod are adjustably connected to opposite ends of a cross bar so as to accurately center the pump rod therebetween; and the cylinders have the ability to closely control the pump cycle rate and length of stroke of the pump rod over a wide range by regulating the pressure and direction of fluid flow to the cylinders. In centering the pump rod between the cylinders, the length of stroke of the pump rod can be reduced enough to enable continuous operation of the pump rod without interfering with other operations, such as, above-ground mobile irrigation systems commonly referred to as center pivot with drop sprinklers and lateral move having a series of sprinkler pipes which are capable of advancing back and forth across an entire field.

Among other features is to provide a pumping system which can be mounted below or above ground level, is more energy efficient with extremely low power requirements compared to traditional horsehead pump jacks so as to allow for use of solar energy as a power source, less maintenance, lightweight and can be easily transported to and from a field in pickup trucks versus full-size tractor trailers commonly required, minimal lifting devices or hoists required for setup and installation, a minimum of moving parts with increased life can be remotely controlled, such as, by means of a computer which will simultaneously control a number of pump jacks with the ability to adjust the pump speed in milliseconds along with the stroke length of the cylinders and pump rod, the pump jacks can be monitored and controlled via internet or telephone with the use of programmable PC boards and which boards can maintain information and provide reports on events, such as, usage, production, failures, power usage, pump volume, system problems, etc. as required by the owner as well as to monitor overall system health including filters, oil levels, pump activity, power source, run time and production levels and with the ability to shut the system down if needed without manual intervention.

In accordance with one aspect, a pump jack for reciprocating a pump rod string in an oil well or other fluid well comprises a ground-engaging base frame, an upper end of the pump rod string extending upwardly through the base frame, and piston drive cylinder assemblies being mounted on the base frame for extension on opposite sides of the pump rod string wherein fluid under pressure is selectively introduced into the cylinder assemblies to reversibly drive each of the pistons in unison to reciprocate the pump rod string. In another aspect, each of the cylinder assemblies includes means for counterbalancing the load or weight of the pump rod string including the amount of fluid being lifted and inertia of the load following each downward stroke as well as to counterbalance the resistance to advancement of the sucker rod string on each upstroke.

Still another aspect is a method of recovering fluids from a subsurface formation wherein a pump rod string extends downwardly into the formation and comprises the steps of mounting a pair of hydraulic fluid cylinder assemblies on opposite sides of the upper end of the pump rod string which extends above the ground, applying hydraulic fluid under pressure to the cylinder assemblies to reciprocate the pump rod string, and counterbalancing the weight of the pump rod string and fluids extracted from the formation so as to establish equilibrium between the hydraulic fluid pressure in the cylinders and the weight of the pump rod string. Most desirably, counterbalancing is achieved by the utilization of a fluid circuit which applies pressure in an upward direction across the upper end of each piston in coordination with the application of hydraulic fluid under pressure to the lower end of each piston on each upstroke and simultaneously releasing the fluid pressure from the upper and lower ends of the pistons when the fluid under pressure acts in a downward direction on the pistons to initiate the downstroke of the pump rod string; and the counterbalancing fluid circuit consists at least in part of a compressible gas, such as, nitrogen alone or nitrogen over oil. Utilization of the counterbalanced cylinders results in extremely low horsepower requirements. For example, normal hydraulic cylinders require 2500-3000 psi whereas counterbalanced cylinders require less than 10% of normal requirements and may even be less than 250 psi of hydraulic pressure. This results also in the ability to utilize smaller cylinders and accommodate any lifting height needed.

In addition to the method and apparatus described above, further aspects and embodiments will become apparent by reference to the drawings and by study of the following descriptions. Exemplary embodiments are illustrated in reference to Figures of the drawings. It is intended that the embodiments and Figures disclosed herein are to be considered illustrative rather than limiting.

DETAILED DESCRIPTION OF ONE EMBODIMENT

Figure 1:
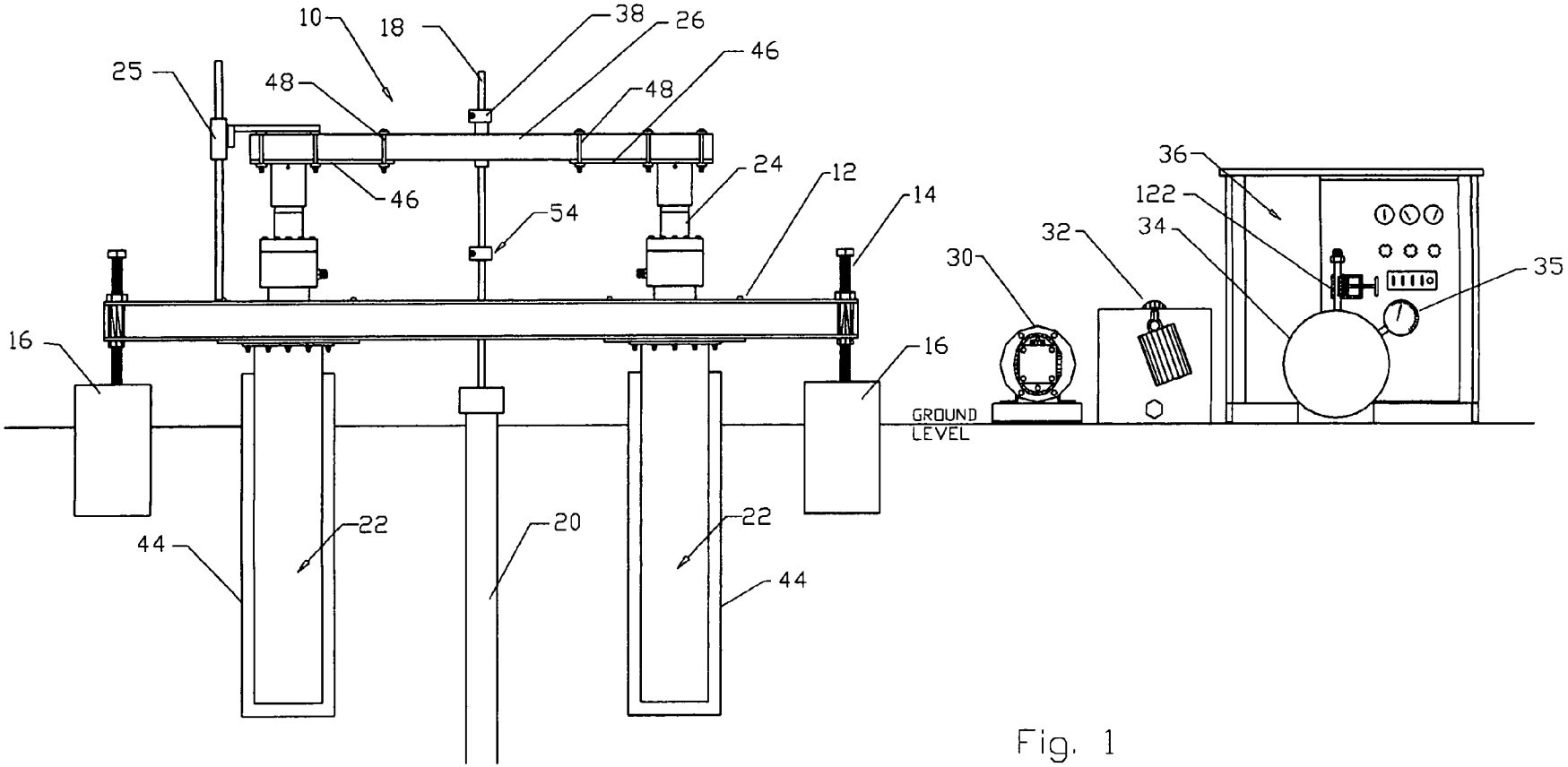
FIG. 1 is a schematic view of one embodiment of pump jack for operating a sucker rod string in a subsurface formation.
Figure 2:
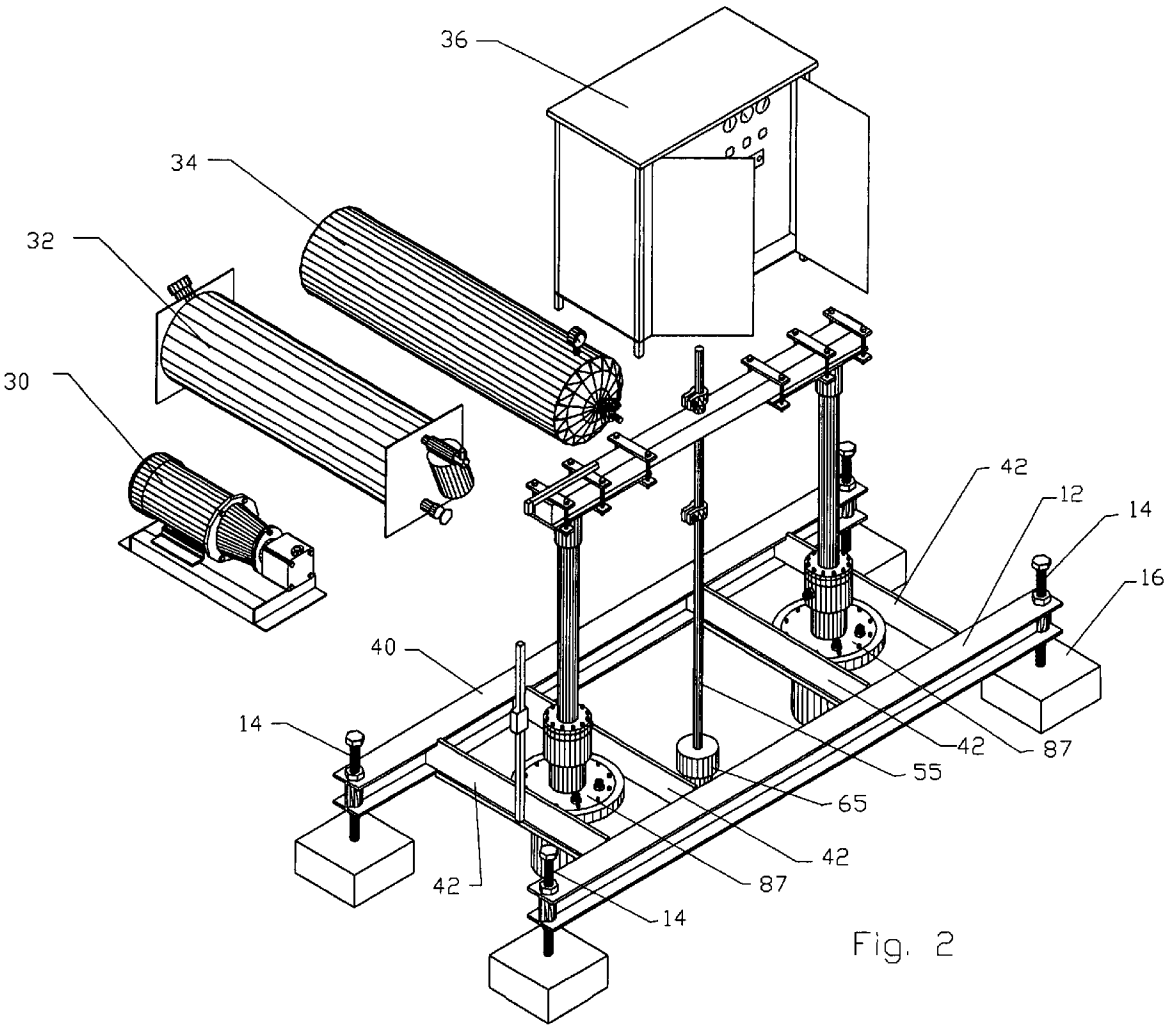
FIG. 2 is a somewhat exploded, perspective view of the pump jack system illustrated in FIG. 1.

Referring in detail to the drawings, there is shown by way of illustrative example in FIGS. 1 and 2 a pump jack system 10 for the extraction of oil and gas from subsurface formations which is broadly comprised of a base frame or platform 12 adjustably mounted by leveling screws 14 in concrete footings 16; and a conventional pump rod extends downwardly through an existing well casing 20 and is flanked on opposite sides by cylinder assemblies 22, each assembly 22 having a piston 24 mounted at its upper end to a cross bar 26. In the embodiment shown in FIGS. 1 to 4, a combination of hydraulic fluid and nitrogen gas are supplied to each cylinder 22 in a manner to be described from a hydraulic motor 30 connected to a reservoir 32 and a nitrogen supply 34. A suitable control panel 36 regulates the supply of hydraulic fluid to the cylinders 22 to control lifting and lowering of the pump rod via the cross bar 26 and pump rod clamps 38 which are adjustably mounted on the upper end of the pump rod.

The pump rod assembly is of conventional construction having a string of rods extending through the well casing and with a downhole pump having a reciprocal plunger which will force the fluid upwardly through the casing on alternate strokes of the pump rod string. The pump rod string may extend downwardly for considerable distances running anywhere from a few hundred feet to several thousand feet deep. Accordingly, on each lift stroke of the pump rod string the cylinder assemblies 22 must be capable of overcoming not only the weight of the pump rod assembly and its downhole accessories, but also the weight of the fluid being lifted to the surface and other inertial and frictional forces as well. Moreover, when the pump rod assembly is reversed to complete each cycle, the cylinders 22 will be forced to overcome equal if not greater loads on each downstroke.

FIG. 2 illustrates in more detail the platform or base frame 12 which is made up of spaced parallel I-beams 40 interconnected by spaced parallel, transverse braces 42, there being a concrete footing 16 at each of the four corners and each can be mounted at the desired depth to compensate for extreme slopes or differences in terrain together with the leveling screws 14. It will be readily apparent that the base frame 12 may be modified for off-shore platform operations. Equally as important, the base frame 12 is installed with respect to an existing pump rod 18 and its casing 20, and in ground operations the necessary bores are drilled into the ground for insertion of the cylinders 22 into cylinder casing protectors 44. Another feature of the embodiment described is the ability to utilize in fields where other above-ground operations are being carried on, such as, automatic irrigation systems having walking beams which traverse extremely large areas of the field and where the irrigation lines are typically raised to no more than 8' to 10' above the ground. In order to permit continuous operation of the pump jack systems it is important to be able to limit the length of stroke of the pump jack and cylinders 22 above the ground surface so as not to interfere with advancement of the irrigation lines while maintaining a substantially constant recovery of the subsurface fluids, such as, oil, gas or water.

Figures 3, 3A:
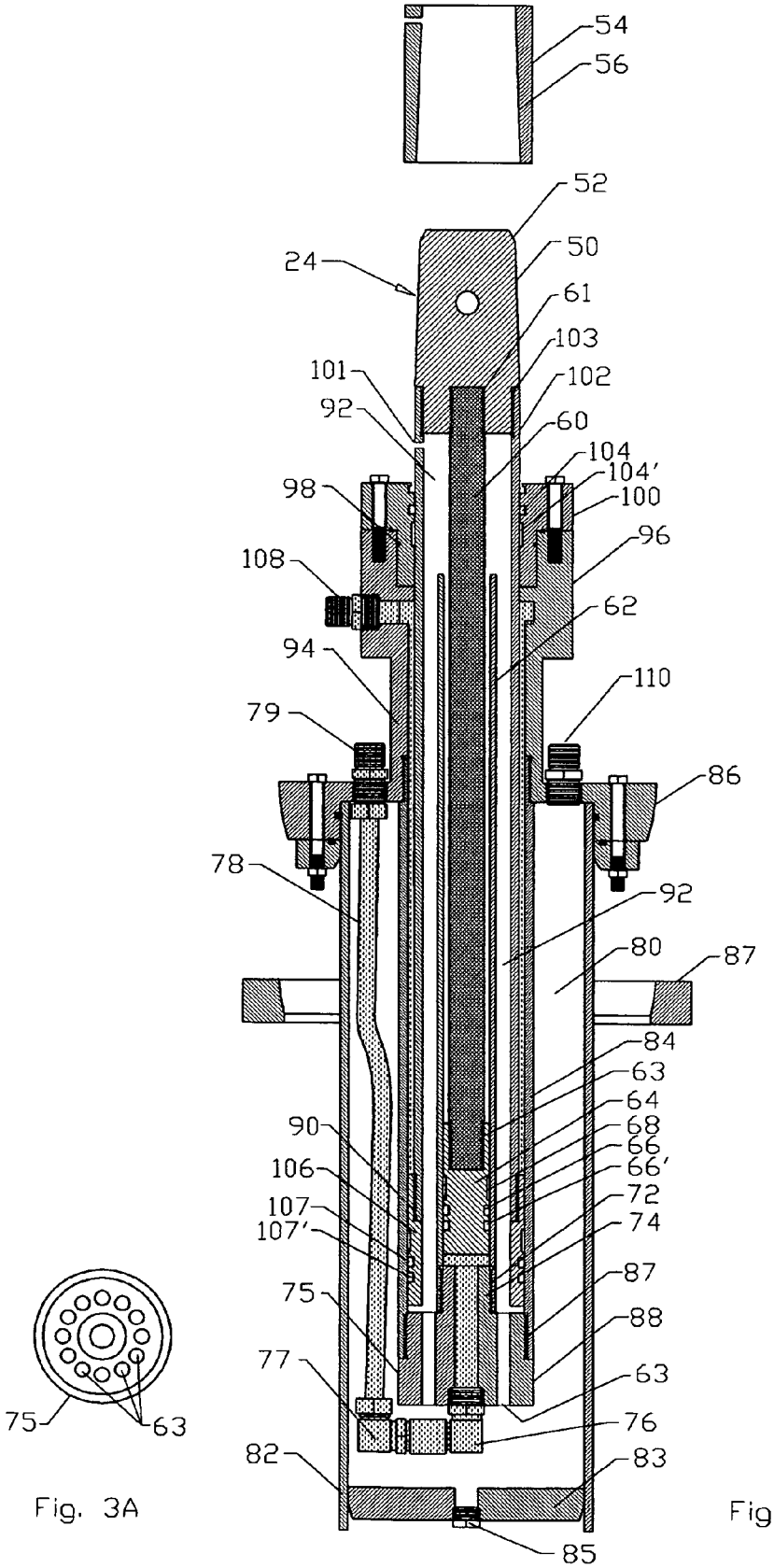
FIG. 3 is a longitudinal section view in more detail of one of the cylinder assemblies.
FIG. 3A is an end view in detail of a cylinder head shown in FIG. 3.

The upper cross bar 26 is in the form of a hollow, generally rectangular beam to which the upper ends of the piston 24 are attached by connecting plates 46. The connecting plates 46 are welded to the upper ends of the pistons 24, and each connecting plate 46 is adjustably attached to the underside of the cross bar 26 by spaced U-bolts or connecting straps 48. The connecting straps 48 enable the connecting plates 46 for the upper piston end to be slidably adjusted lengthwise of the cross bar 26 until the pump rod 18 is accurately centered between the pistons. Referring to FIG. 3, it is to be noted that the upper end of each piston 24 includes a solid tapered head 50 with an upper beveled edge 52 and which is inserted into a tubular receiver 54 having an inner tapered wall 56 complementary to the external tapered wall surface of the head 50, and the upper edge of the receiver 54 is welded to the connecting plate 46 with the tapered head 50 firmly wedged into the receiver 54.

Figure 4:
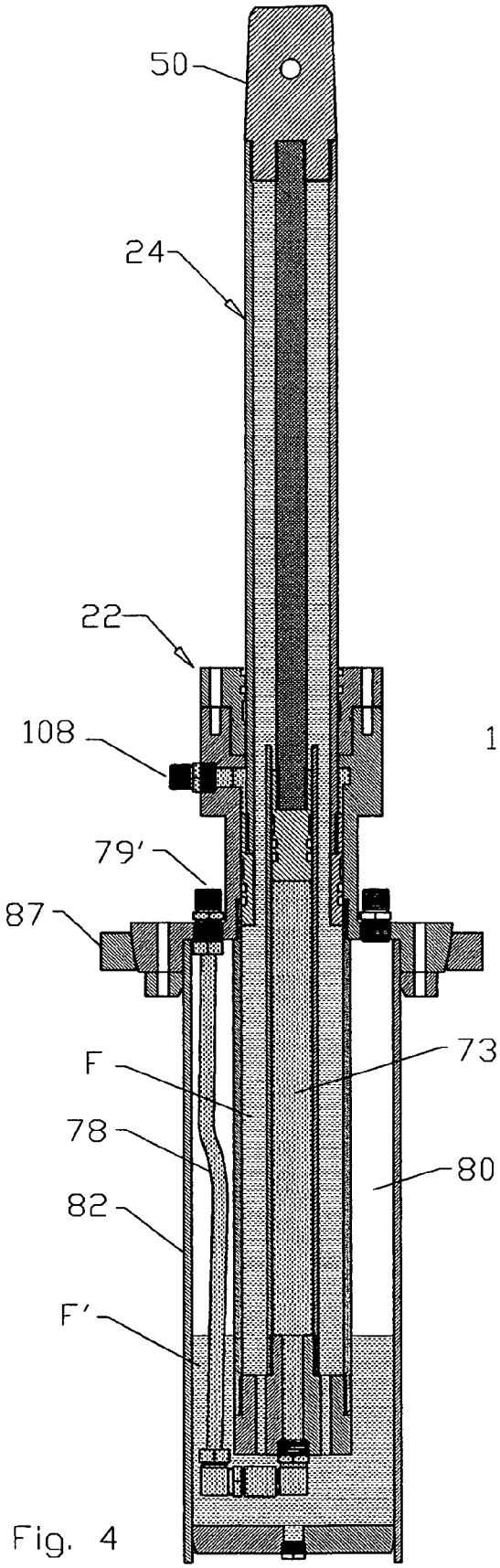
FIG. 4 is another longitudinal section view of the main component parts of the cylinder assembly being illustrated in FIG. 3 at the completion of an upstroke or in the raised position.
Figure 5:
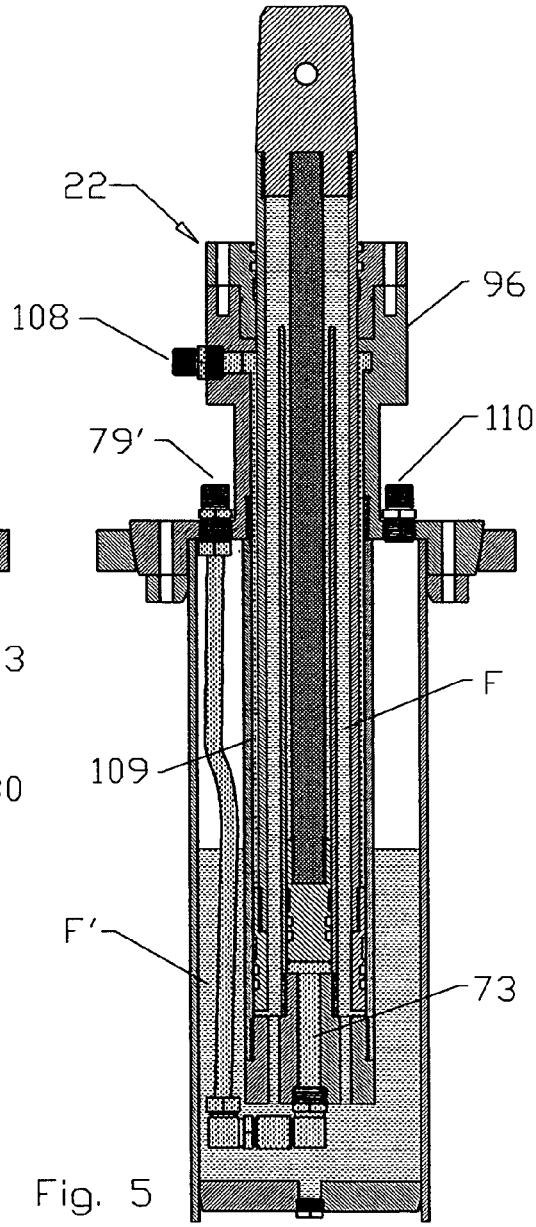
FIG. 5 is another longitudinal section view of the cylinder assembly shown in FIGS. 3 and 4 with the piston at the completion of its downstroke.

FIGS. 4 and 5 illustrate in more detail one of the piston assemblies 24 in the raised and lowered positions, respectively. Each piston assembly 24 is comprised of an elongated piston shaft 60 having an upper threaded end 61 permanently attached to the upper enlarged end 50 and extends downwardly through a smaller diameter piston tube 62 to terminate in a lower end 63 which is permanently attached to a piston head 64 receiving seals 66, 66' and wear ring 68 in slidable but sealed engagement with the inner wall of the piston tube 62. The piston tube 62 terminates in a lower threaded end 72 attached to an upper end of an inner wall 74 of cylinder head 75. A central bore in the head 75 receives an elbow-shaped fitting 76 joined to a second fitting 77 at the lower end of a hydraulic pipe 78 from a port 79.

The hydraulic delivery pipe 78 extends downwardly through annulus or outer chamber 80 between outer concentric cylinder 82 and an inner concentric, lower cylindrical extension 84. The extension 84 extends downwardly from an alignment ring 86 at the upper end of outer cylinder 82 and has a lower threaded end 87 attached to an outer wall 88 of the head 75 which is of increased thickness in relation to the tube 84 and is integral with and in outer spaced concentric relation to the sleeve 74. A series of closely-spaced bores 63 extend in circumferentially spaced relation to one another vertically through an intermediate portion of the head 75 between the inner wall 74 and outer wall 88 in order to establish communication for the flow of oil between the inner and outer chambers 92 and 80, respectively. The alignment ring 86 has an outer surface formed on a curved radius which is wedged into engagement with a complementary inner surface on an annular seat 87 so as to be self-aligned on the seat 87 and is mounted between the crossbars 42 as shown in FIG. 2. In FIG. 3, the alignment guide 86 is shown in spaced relation to the seat 87 for the purpose of clarity but in actual operation will remain in seated engagement with the member 87, as illustrated in FIGS. 4 and 5.

A larger diameter piston tube 102 has an upper internally threaded end 103 permanently attached to the upper tapered head 50 of the piston shaft 60, the tube 102 extending downwardly in slidable but sealed engagement through the cylinder cap 100 and the cap 100 having inner seals 104, 104' at its upper end in sealing contact with the outer tube 102. The tube 102 continues downwardly to terminate in a sleeve 106 in sealed but slidable engagement with the lower cylindrical extension 84, the sleeve 106 having an external shoulder 90 at the upper end and oil seals 107, 107' interposed between the sleeve end portion 106 and the cylindrical extension 84. A port 108 extends through the upper end 96 into communication with an annular fluid passage 109 between the lower cylindrical extension 84 and the piston tube 102 to drive the piston from the raised position shown in FIG. 4 to the lowered position shown in FIG. 5 in a manner to be described.

Figure 6:
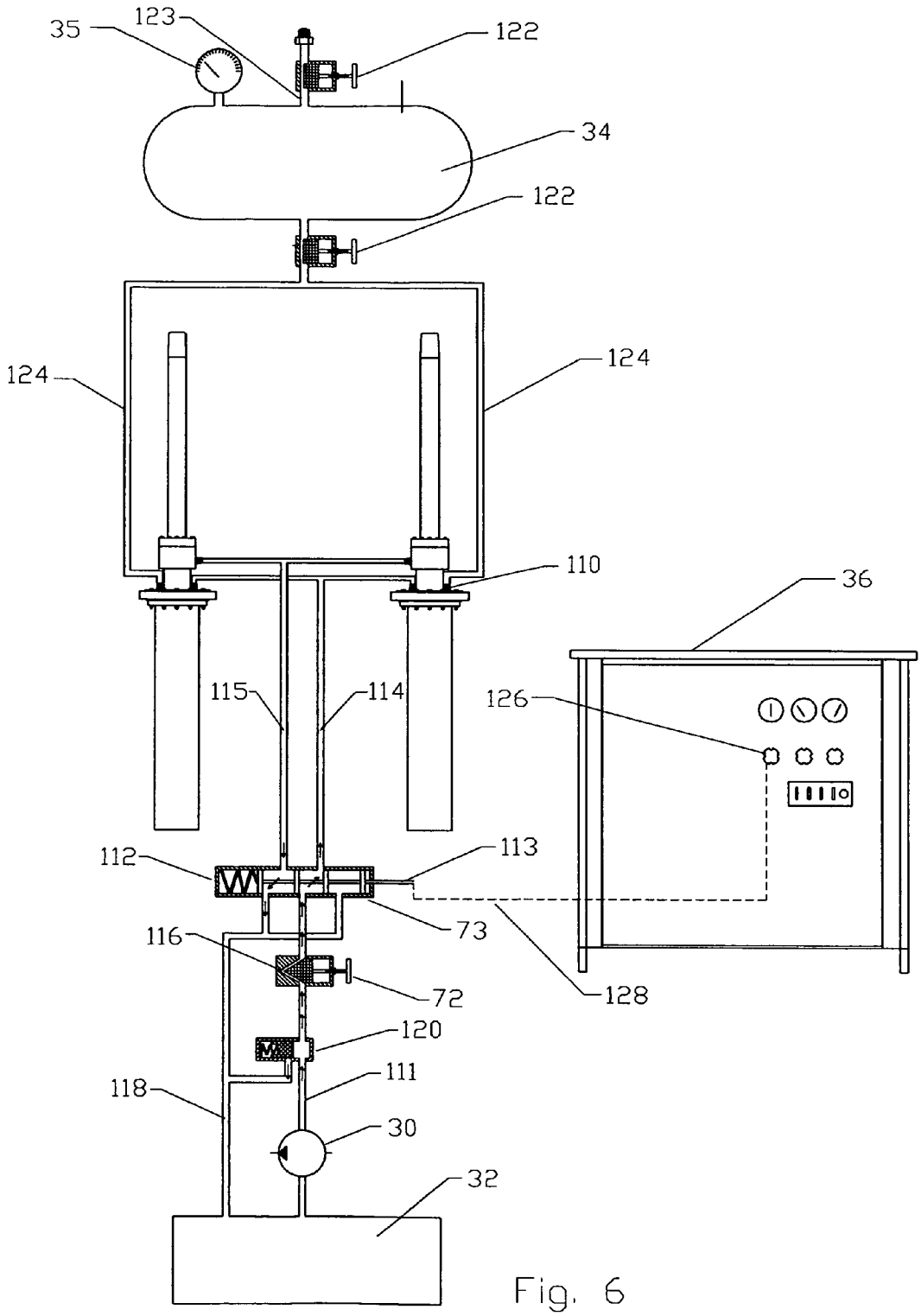
FIG. 6 is a schematic view of the pump jack system of FIGS. 1 and 2 and illustrating the hydraulic control circuit as well as gas supply for counterbalancing the cylinders.

A port 110 is positioned in the alignment ring 86 for the introduction of nitrogen under pressure into the annulus 80 to counterbalance the weight of the pump rod string in a manner to be described. In this relation, the lower end of the outer cylinder 82 is closed by an end plate 83 having a drain plug 85. However, the head 75 at the lower ends of the tubes 62 and 102 has a series of bores 63 so that the passage 92 between the tubes 62 and 102 is in open fluid communication with the annulus 80. The annulus 80 is filled with hydraulic fluid to a level such that when the annulus is precharged with an inert gas, such as, nitrogen under pressure from supply tank 34 will force the hydraulic fluid upwardly to fill the inner chamber 92, as shown in FIG. 6, and any air in the chamber 92 will escape through bleed hole 101 at the upper extreme end of the piston tube 102. The tank 34 is filled with nitrogen gas from a suitable source, such as, a pressurized nitrogen bottle through inlet line 123 having a shut-off valve 122. In turn, outlet lines 124 lead from the tank 34 into the ports 110 to fill each annulus 80 as described, and the nitrogen gas pressure can be regulated by the pressure regulator 35 to establish the desired equilibrium between the gas G and oil F' as represented in FIG. 4. Another valve 122 in the line 124 is then closed after the pump rod has been counterbalanced. It is important to note that the oil represented at F and F' is isolated from the hydraulic control circuit associated with the pump 30 and tank 32 in neutralizing or counterbalancing the weight of the pump rod 18 and oil or other fluid being lifted from the formation as earlier described.

As further illustrated in FIGS. 4 to 6, the hydraulic pump 30 supplies hydraulic fluid under pressure via line 111 through a directional control valve 112 and lift line 114 into each of the ports 79 and the pipe 78 upwardly into inner concentric passageway 73 in the sleeve 74 to act across the bottom surface of the piston end 64 in both cylinders 22. A flow control valve 116 in the line 111 either can be manually or remotely controlled to regulate the fluid volume delivered to the piston end 64 in driving each piston shaft 60 in an upward direction through each respective piston tube 62. In lifting or raising the pistons 24, the fluid pressure across the piston ends 64 will be augmented by the fluid pressure in the chamber 92 so that the fluid level in the outer chamber 80 will be lowered as it is forced into the chamber 92 by the nitrogen gas under pressure. The pistons 24 in the cylinders 22 are raised in unison by the hydraulic control circuit as described to lift the sucker rod 18 a predetermined distance as determined by the directional control valve 112. The valve spool 113 is shifted to the left as illustrated in FIG. 6 under the control of a limit switch 25 which is positioned in the path of travel of the cross bar 25, as illustrated in FIG. 1. The limit switch may be adjusted in height to control the length of stroke of the sucker rod 18.

By reversing the flow of fluid through the directional control valve 112, the hydraulic fluid under pressure is directed through the line 115 to the ports 108 of the cylinders to supply the hydraulic fluid under pressure via the outer passage 109 between the outer piston tube 102 and the cylindrical extension 84 so as to act across the external shoulder 90 at the upper end of the sleeve and drive each of the pistons downwardly to reverse the stroke of the sucker rod 18. The hydraulic fluid under pressure in the delivery pipe 78 is free to return through the line 114 and a lower return line 118 into the hydraulic reservoir 32. Simultaneously, the upper ends 24 of the pistons 24 will force some of the hydraulic fluid in the inner chamber 92 to return to the annulus 80 and compress the nitrogen to some extent so that the hydraulic fluid level will be raised in comparison to its level at the beginning of the downstroke as shown in FIG. 4. Accordingly, at the end of the downstroke of the pistons 24 and sucker rod 18 as shown in FIG. 5 the nitrogen gas and hydraulic fluid in the outer annulus 80 will return to equilibrium in counterbalancing the weight of the sucker rod at the beginning of the lift stroke. A pressure relief valve 120 in the control line 111 permits hydraulic fluid to return to the tank 32 via line 118 in the event of an overload condition.

For the purpose of illustration but not limitation, the nitrogen gas pressure may be on the order of 300 psi to 350 psi for deeper wells; and for shallow wells may be reduced substantially. Once the pump rod 18 has been counterbalanced, the stroke speed can be set by controlling the volume or mass rate of flow of the hydraulic fluid through the flow control valve 72, and the length of stroke can be regulated by the limit switch 25 as discussed earlier, or by a suitable remote control switch represented at 126 on the irrigation control panel. Thus, in a circle irrigation system, the remote control timer switch 126 is connected via line 128 to the valve 113 to selectively shorten the pump rod stroke so as not to interfere with the advancement of the irrigation control line in traversing each of the pump rods. Moreover, the hydraulic fluid pressure may be varied proportionately with the length of stroke so that, for example, when the length of stroke is reduced the hydraulic pressure will be increased to increase the speed of the stroke and pump the same amount of fluid from the well.

Detailed Description of Another Embodiment

Figure 7:
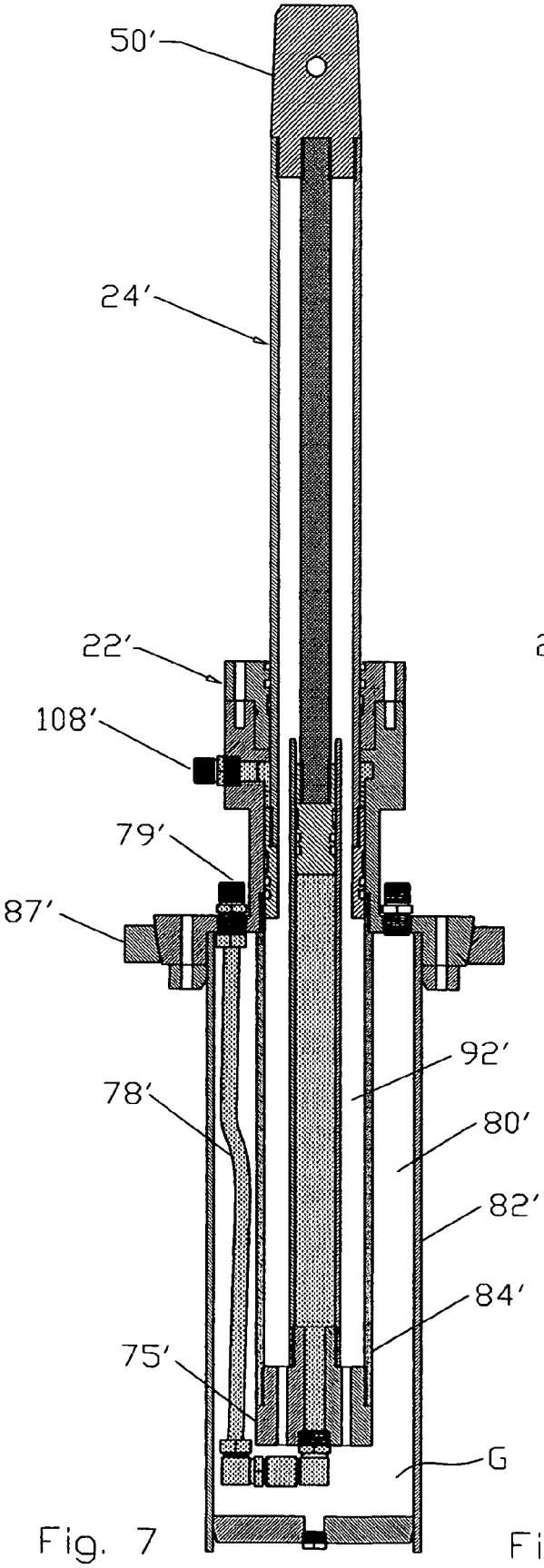
FIG. 7 is a longitudinal sectional view of another embodiment of a cylinder assembly utilizing nitrogen gas only as the counterbalancing fluid, the cylinder assembly being illustrated in the raised position.
Figure 8:
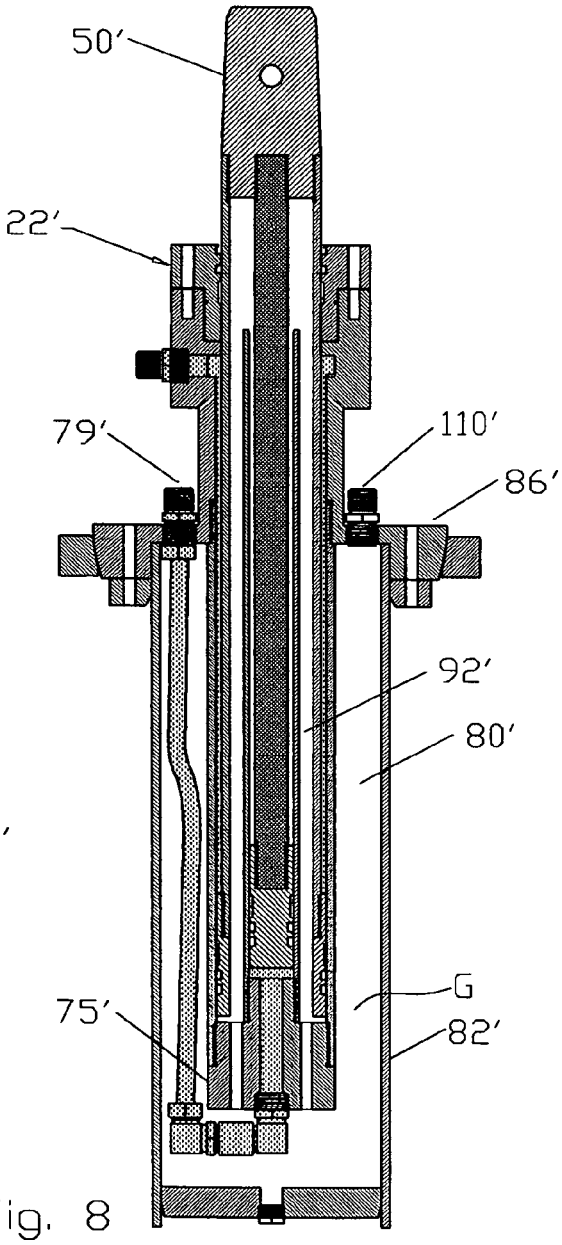
FIG. 8 is a longitudinal sectional view of the cylinder assembly of FIG. 7 and being illustrated at the completion of its downstroke.

FIGS. 7 and 8 illustrate a cylinder assembly 22' for another embodiment of a pump jack system and wherein like parts are correspondingly enumerated with prime numerals. In fact, the cylinder assembly 22' corresponds to the cylinder assembly 22' of the one embodiment but utilizes nitrogen gas G only in place of the nitrogen gas over oil as the counterbalancing fluid. Although not shown, the hydraulic control circuit for the cylinder assemblies as well as the nitrogen supply tank are identical to that illustrated and described in FIGS. 1 to 6, but a hydraulic fluid or oil is not introduced into the annulus 80' or chamber 92'. Instead, the nitrogen gas is introduced into port 110' until it reaches a pressure level necessary to counterbalance the load of the pump rod string 18 as earlier described in connection with FIGS. 1 to 6. The nitrogen gas pressure level is suitably regulated by the pressure regulator 35 on the supply tank 34 so that once the proper equilibrium is established will be closed. Accordingly, on the downstroke shown in FIG. 8, the piston head 50' will advance downwardly to force the nitrogen gas out of the chamber 92' and into the annulus 80' so as to slightly increase the nitrogen gas pressure in the annulus 80'. Conversely, on the upward stroke shown in FIG. 7, the nitrogen gas will follow upward movement of the piston head 50' to fill the fluid passage 92' and slightly reduce the pressure of the nitrogen gas in preparation for the next downstroke.

Among other advantages, in the utilization of nitrogen gas G over the oil F and F' in FIGS. 1 to 6 is that those seals which are exposed to the oil F rather than the gas G are not as susceptible to leakage, and any wear surfaces between the piston end 64 and tube 62 are lubricated and therefore are longer-lasting in the field.

It is therefore to be understood that while several embodiments or aspects are herein set forth and described, the above and other modifications may be made therein without departing from the spirit and scope of the invention as defined by the appended claims and reasonable equivalents thereof.

I claim:

1. A pump jack system for reciprocating a pump rod string in an oil or gas well and the like comprising:

a ground-engaging base frame, and an upper end of said pump rod string extending upwardly through said base frame;

piston drive cylinder assemblies mounted on said base frame for extension on opposite sides of said pump rod, each of said assemblies including inner and outer concentric fluid passages and means for introducing fluid under pressure to each of said passages for reversibly driving said pistons in unison;

means operatively connecting said pistons to said pump rod for reciprocating said pump rod in said well; and means in each of said cylinder assemblies for counterbalancing the weight of said pump rod string, said counterbalancing means being composed at least in part of an inert gas.

2. A pump jack system according to claim 1 wherein said counterbalancing means includes inner and outer concentric chambers in each of said cylinder assemblies, and lower ends of said inner and outer chambers being in communication with one another.

3. A pump jack system according to claim 2 wherein said counterbalancing fluid is oil which is isolated from said hydraulic fluid under pressure which is introduced into said inner and outer concentric fluid passages.

4. A pump jack system according to claim 3 wherein an inert gas is introduced into each of said outer chambers in overlying relation to said hydraulic fluid.

5. A pump jack system according to claim 2 wherein means are provided for introducing fluid under pressure into said inner and outer chambers for counterbalancing the weight of said pump rod.

6. A pump jack system according to claim 5 wherein said fluid under pressure is composed at least in part of an inert gas.

7. A pump jack system according to claim 1 wherein each of said pistons includes a piston shaft slidable in sealed engagement through an inner concentric piston tube, and an outer piston tube is mounted for reciprocal movement with each of said piston shafts in outer spaced concentric relation to said inner piston tube.

8. A pump jack system according to claim 7 wherein means are provided for directing said hydraulic fluid under pressure against a lower end of said inner piston tubes to drive each of said pistons upwardly and lift said pump rod.

9. A pump jack system according to claim 8 wherein each of said outer piston tubes is slidable in sealed engagement with an outer cylindrical wall, and means are provided for introducing hydraulic fluid under pressure downwardly against a shoulder on each of said outer piston tubes whereby to drive each of said pistons downwardly.

10. A pump jack assembly for reciprocating a pump rod in an oil, water or gas well comprising:

a base frame having said pump rod mounted for reciprocal movement into the well;

piston drive cylinders mounted on said base frame for extension on opposite sides of said pump rod;

means for introducing hydraulic fluid under pressure into inner and outer concentric fluid passages in each of said cylinders for reversibly driving each of said pistons in unison;

an upper beam extending between upper ends of said pistons and said pump rod including means adjustably connecting upper ends of said pistons to said beam whereby to center said pump rod therebetween;

means in each of said cylinders for counterbalancing said hydraulic fluid under pressure; and wherein each of said pistons includes a piston shaft slidable in sealed engagement through an inner concentric piston tube, and an outer piston tube is mounted for reciprocal movement with each of said piston shafts in outer spaced concentric relation to said inner concentric piston tube.

11. A pump jack assembly according to claim 10 wherein each of said cylinders includes inner and outer concentric chambers in outer concentric relation to said pistons with lower ends of said chambers in communication with one another.

12. A pump jack assembly according to claim 11 wherein said counterbalancing means includes oil and an inert gas.

13. A pump jack assembly according to claim 12 wherein said inert gas is introduced into each of said outer concentric chambers in overlying relation to oil in said inner and outer concentric chambers.

14. A pump jack assembly according to claim 10 wherein means are provided for directing said hydraulic fluid under pressure against a lower end of each of said inner piston tubes at one end of said inner concentric fluid passage to drive each of said pistons upwardly and lift said pump rod.

15. A pump jack assembly according to claim 14 wherein each of said outer piston tubes is slidable in sealed engagement with an outer cylindrical wall, and means are provided for introducing hydraulic fluid under pressure downwardly against a shoulder on each of said outer piston tubes whereby to drive each of said pistons downwardly at one end of each said outer concentric fluid passage.

16. A pump jack assembly according to claim 10 having hydraulic control circuit means including flow control means for regulating the length of stroke and speed of said pistons, a limit switch adjustably mounted on said base frame to adjustably control the length of stroke of said pistons and said pump rod, said hydraulic control circuit including a directional control valve, and said limit switch connected to said directional control valve to regulate the directional flow of said hydraulic fluid under pressure into said cylinders.

17. A pump jack assembly according to claim 10 wherein a limit switch is adjustably mounted on said base frame to adjustably control the length of stroke of said pistons and pump rod.

18. A pump jack assembly according to claim 17 wherein said hydraulic control circuit means includes a directional control valve, said limit switch connected to said directional control valve to regulate the directional flow of said hydraulic fluid under pressure into said cylinders.

19. The method of recovering fluids from a subsurface formation wherein a pump rod extends downwardly into the subsurface formation, said pump rod having an upper end extending above the ground comprising the steps of:

mounting a pair of hydraulic fluid cylinders on opposite sides of the upper end of said pump rod;

applying hydraulic fluid under pressure alternately to inner and outer concentric fluid passages in said cylinders to reciprocate said pump rod;

counterbalancing the weight of said pump rod and fluids being extracted from said subsurface formation to establish equilibrium between the hydraulic fluid pressure level in said cylinders and the weight of said pump rod; and counterbalancing the weight of said pump rod with a counterbalancing fluid circuit in each of said cylinders, wherein said counterbalancing fluid circuit includes an inert gas.

20. The method according to claim 19 including the step of adjustably controlling the length of stroke of said pistons and pump rod, adjustably controlling the speed of said pistons and said pump rod in relation to the length of stroke, and synchronizing the length of stroke of said pistons and said pump rod to avoid interference with the travel of an above-ground irrigation system, and coordinating the speed of said pistons with their length of stroke in order to maintain substantially constant recovery of fluids from the well.

21. The method according to claim 20 including the step of adjustably controlling the speed of said pistons and said pump rod in relation to the length of stroke.

22. The method according to claim 19 wherein said inert gas is nitrogen.

23. The method according to claim 19 including the step of synchronizing the length of stroke of said pistons and said pump rod to avoid interference with the travel of an above ground irrigation system.

24. The method according to claim 19including the step of coordinating the speed of said pistons with their length of stroke in order to maintain substantially constant recovery of fluids from the well.

* * * * *